US008824631B2

(12) United States Patent
Mitsuda et al.

(10) Patent No.: US 8,824,631 B2
(45) Date of Patent: Sep. 2, 2014

(54) X-RAY REFLECTING DEVICE

(75) Inventors: Kazuhisa Mitsuda, Sagamihara (JP); Manabu Ishida, Sagamihara (JP); Yuichiro Ezoe, Hachioji (JP); Kazuo Nakajima, Sendai (JP)

(73) Assignees: Japan Aerospace Exploration Agency, Tokyo (JP); Tokyo Manufacturing University, Tokyo (JP)

( * ) Notice: Subject to any disclaimer, the term of this patent is extended or adjusted under 35 U.S.C. 154(b) by 0 days.

(21) Appl. No.: 13/008,866

(22) Filed: Jan. 18, 2011

(65) Prior Publication Data

US 2011/0110499 A1 May 12, 2011

Related U.S. Application Data

(63) Continuation of application No. PCT/JP2009/063031, filed on Jul. 21, 2009.

(30) Foreign Application Priority Data

Jul. 18, 2008 (JP) ..... 2008-186840

(51) Int. Cl.
*G21K 1/06* (2006.01)

(52) U.S. Cl.
CPC ..... *G21K 1/067* (2013.01); *G21K 2201/062* (2013.01); *G21K 2201/064* (2013.01)
USPC ..... 378/85; 378/84; 250/505.1

(58) Field of Classification Search
CPC .... G21K 1/06; G21K 2201/062; G21L 1/067; G21L 2201/064
USPC ..... 378/84, 85; 250/505.1
See application file for complete search history.

(56) References Cited

U.S. PATENT DOCUMENTS 4,461,018 A * 7/1984 Ice et al. ..... 378/84
4,599,741 A * 7/1986 Wittry ..... 378/85

(Continued)

FOREIGN PATENT DOCUMENTS

FR 2 901 628 A1 11/2007
JP 6112174 A 4/1994

(Continued)

OTHER PUBLICATIONS

Office Action for corresponding Japanese Patent Application No. 2008-186840, mailed on Dec. 19, 2011, 4 pgs.

(Continued)

*Primary Examiner* — Allen C. Ho
(74) *Attorney, Agent, or Firm* — Blakely, Sokoloff, Taylor & Zafman LLP

(57) ABSTRACT

Provided is a technique for X-ray reflection, such as an X-ray reflecting mirror, capable of achieving a high degree of smoothness of a reflecting surface, high focusing (reflecting) performance, stability in a curved surface shape, and a reduction in overall weight. A silicon plate (silicon wafer) is subjected to thermal plastic deformation to form an X-ray reflecting mirror having a reflecting surface with a stable curved surface shape. The silicon wafer can be deformed to any shape by applying a pressure thereto in a hydrogen atmosphere at a high temperature of about 1300° C. The silicon plate may be simultaneously subjected to hydrogen annealing to further reduce roughness of a silicon surface to thereby provide enhanced reflectance.

12 Claims, 4 Drawing Sheets

(56) References Cited

U.S. PATENT DOCUMENTS

| | | | | | |
|---|---|---|---|---|---|
| 4,807,268 | A * | 2/1989 | Wittry | 378/84 |
| 4,949,367 | A * | 8/1990 | Huizing et al. | 378/84 |
| 5,016,267 | A * | 5/1991 | Wilkins | 378/84 |
| 5,163,078 | A * | 11/1992 | Iketaki | 378/85 |
| 5,239,566 | A * | 8/1993 | Nakamura et al. | 378/43 |
| 5,353,324 | A * | 10/1994 | Kitano | 378/73 |
| 5,555,333 | A * | 9/1996 | Kato | 385/89 |
| 5,757,883 | A | 5/1998 | Haisma et al. | |
| 5,887,048 | A * | 3/1999 | Sata et al. | 378/84 |
| 6,236,710 | B1 * | 5/2001 | Wittry | 378/84 |
| 6,278,764 | B1 * | 8/2001 | Barbee et al. | 378/84 |
| 6,285,506 | B1 * | 9/2001 | Chen | 359/642 |
| 6,295,164 | B1 * | 9/2001 | Murakami et al. | 378/84 |
| 6,317,483 | B1 * | 11/2001 | Chen | 378/84 |
| 6,498,830 | B2 * | 12/2002 | Wittry | 378/84 |
| 6,829,327 | B1 * | 12/2004 | Chen | 378/44 |
| 7,035,374 | B2 * | 4/2006 | Chen | 378/84 |
| 8,142,691 | B2 * | 3/2012 | Hill et al. | 264/1.7 |
| 8,406,379 | B2 * | 3/2013 | Okuda et al. | 378/147 |
| 2008/0121824 | A1 | 5/2008 | Kabuki et al. | |

FOREIGN PATENT DOCUMENTS

| | | | |
|---|---|---|---|
| JP | 8201589 | A | 8/1996 |
| JP | 09-230099 | | 9/1997 |
| JP | H 10502741 | A | 3/1998 |
| JP | 2007-127511 | | 5/2007 |
| JP | 2007-285909 | | 11/2007 |
| JP | 2008/180656 | A | 8/2008 |
| WO | WO 2007/072906 | | 6/2007 |

OTHER PUBLICATIONS

Japanese Patent Application No. 2008-186840, Office Action, Mailing date Oct. 12, 2012, 3 pages.

EPO Communication enclosing Extended European Search Report for European Counterpart Application No. 09798010.6, 7 pages, (May 3, 2013).

R. Hudec, et al., "Recent Progress with X-ray Optics Based on Si Wafers and Glass Foils", Proc. of SPIE, vol. 7011, pp. 701116-1-701116-12, (Jul. 12, 2008).

PCT International Search Report for PCT Counterpart Application No. PCT/JP2009/063031 containing Communication relating to the Results of the Partial International Search Report, 6 pgs., (Oct. 20, 2009).

PCT Written Opinion of the International Searching Authority for PCT Counterpart Application No. PCT/JP2009/063031, 5 pgs., (Oct. 20, 2009).

W. W. Zhang, et al., "Mirror Technology Development for the International X-ray Observatory Mission (IXO)", Proc. SPIE, vol. 7732, 77321G, 1 pg., Abstract Only, (Jul. 29, 2010).

Maximilien J. Collon, et al., "Silicon Pore X-ray Optics for IXO", Proc. SPIE, vol. 7732, 77321F, 1 pg., Abstract Only, (Jul. 29, 2010).

Yuichiro Ezoe, et al., "Shaped Silicon Wafers obtained by Hot Plastic Deformation: Performance Evaluation for Future Astronomical X-ray Telescopes", Applied Optics, vol. 48, No. 19, pp. 3830-3838, (Jul. 1, 2009).

Yuichiro Ezoe, et al., "Development of High-Resolution and Light-Weight X-Ray Optics with Deformed Silicon Wafers", Proc. SPIE 7360, 73600B, 8 pgs., (Apr. 30, 2009).

Nobuhiko Sato, et al., "Hydrogen Annealed Silicon-on-insulator", Applied Physics Letters, vol. 65, No. 15, pp. 1924-1926, (Oct. 10, 1994).

Kazuo Nakajima, et al., "Shaped Silicon-Crystal Wafers obtained by Plastic Deformation and their Application to Silicon-Crystal Lenses", Nature Materials, vol. 4, pp. 47-50, (Jan. 2005).

Marcos Bavdaz, et al., "Status of X-ray Optics Development for the XEUS Mission", Proc. SPIE, vol. 5488, pp. 829-836, (2004).

T. Namioka, et al., "X-ray Crystal Optics", Baifukan Co., Ltd., pp. 135-143, 1999.

* cited by examiner (a)

(b)

(a)

(b)

X-RAY REFLECTING DEVICE

CROSS-REFERENCE TO RELATED APPLICATIONS

This patent application is a continuation of International Application No. PCT/JP2009/063031, filed on Jul. 21, 2009, entitled X-RAY REFLECTING MIRROR, X-RAY REFLECTING APPARATUS AND X-RAY REFLECTOR USING THE X-RAY REFLECTING MIRROR, AND METHOD FOR PREPARING X-RAY REFLECTING MIRROR, which claims priority to Japanese patent application number 2008-186840, filed Jul. 18, 2008.

TECHNICAL FIELD

The present invention relates to an X-ray reflecting device for use in instruments for X-ray observation in cosmic space, or instruments for radiation measurement and microanalysis on the earth.

BACKGROUND ART

Differently from visible light, normal incidence optics is hardly usable for X-rays. For this reason, taking advantage of the fact that a refractive index of metal with respect to an X-ray is less than one, a grazing-incidence optics based on total reflection on a metal surface is used for X-rays. In this case, a critical angle for the total reflection is as small as about 1 degree. Thus, as means to obtain a larger effective area of a reflecting surface, there has been known a technique of concentrically arranging a large number of cylindrical-shaped metal reflecting mirrors different in diameter. However, this technique causes an increase in overall weight of an X-ray reflecting device, so that the X-ray reflecting device will be of difficult to transport from the earth for use in cosmic space.

Moreover, in order to ensure reflectance at a certain level or more, the smoothness of a surface of each reflecting mirror in the X-ray reflecting device is required to be comparable to the wavelength of an X-ray. Therefore, in the X-ray reflecting device, there has been a need for subjecting the reflecting surface to polishing so as to smooth the surface. Thus, for example, after preparing a large number of replica mirrors by pressing a thin film onto a polished master die, reflecting mirrors have been produced one by one while spending a lot of time and effort (see the following Non-Patent Document 1). As means for reducing the weight of the mirror, there has also been known a technique of using a thin aluminum foil as a mirror. However, this technique has an disadvantage of causing deterioration in focusing performance due to deformation or distortion of the foil (see the Non-Patent Document 1).

Therefore, a group of the European Space Research and Technology Centre (ESTEC) of the European Space Agency (ESA) has proposed a technique of using a surface-polished silicon wafer as an X-ray reflecting mirror (see the following Non-Patent Document 2). A surface of a commercially-available polished silicon wafer has angstrom-level smoothness, and thereby can be directly used as an X-ray reflecting mirror. A wafer surface is capable of being finished to an extremely precise flatness, and therefore is excellent in focusing performance. A silicon wafer has a thickness approximately equal to that of an aluminum foil, and therefore can provide a relatively lightweight optics.

In cases where an optics is made by the technique described in the Non-Patent Document 2, a silicon wafer is subjected to press-bending, i.e., elastic deformation, to have a shape close to an ideal curved surface, and then a large number of mirrors are formed side-by-side in a concentric arrangement. However, in the silicon wafer subjected to elastic deformation, due to slight shifting of a pressing direction caused by fine dust trapped between a pressing member and the silicon wafer, aging, temperature change, etc., a deviation occurs in a curved surface shape of the mirror, which causes a problem of instability in focusing performance.

[Non-Patent Document 1] T. Namioka, K. Yamashita, "X-ray Crystal Optics", BAIFUKAN Co., Ltd. (pp. 136-143, etc) (concerning conventional X-ray reflecting devices and multilayer reflecting mirrors)

[Non-Patent Document 2] Bavdaz et al., 2004, Proc. of SPIE, 5488, 829 (concerning an X-ray optics using a surface-polished silicon wafer in an elastically deformed state)

[Non-Patent Document 3] Nakajima et al., 2005, Nature Materials, 4, 47 (concerning an optics utilizing Bragg reflection and thermal plastic deformation of a silicon wafer) [Non-Patent Document 4] Sato & Tonehara, 1994, applied Physics Letter, 65, 1924 (concerning surface smoothing of a silicon wafer by hydrogen annealing)

SUMMARY

In view of the above problems, it is the objects of the present invention to provide an X-ray reflecting device capable of being produced in a lightweight and relatively simple manner, an X-ray reflecting mirror constituting the X-ray reflecting device, and a method of producing the X-ray reflecting mirror.

In order to achieve the above objects, according to a first aspect of the present invention, there is provided an X-ray reflecting mirror which comprises a silicon plate body subjected to plastic deformation, and a reflecting surface having a degree of smoothness available for X-ray reflection, wherein the reflecting surface is formed in a given curved surface shape by means of the plastic deformation.

In the above X-ray reflecting mirror, the curved surface shape may include a part of a paraboloid of revolution and a part of a hyperboloid of revolution.

According to a second aspect of the present invention, there is provided an X-ray reflecting device which comprises a plurality of the above X-ray reflecting mirrors, wherein the X-ray reflecting mirrors are arranged around a straight line so that the straight line becomes a rotation axis for the X-ray reflecting mirrors, and wherein an angle of each of the X-ray reflecting mirrors is set to allow X-rays entering parallel to the axis to be reflected once at each of the paraboloid-of-revolution surface and the hyperboloid-of-revolution surface, and then converged.

According to a third aspect of the present invention, there is provided an X-ray reflecting mirror which comprises: a silicon plate body subjected to plastic deformation; a reflecting surface having a degree of smoothness available for X-ray reflection, wherein the reflecting surface is formed in a given curved surface shape by means of the plastic deformation; and a large number of X-ray passage grooves formed on a reverse side of the reflecting surface to extend parallel to each other.

According to a fourth aspect of the present invention, there is provided an X-ray reflector which comprises a plurality of the above X-ray reflecting mirrors, wherein the X-ray reflecting mirrors are laminated such that the reflecting surface and the groove-formed side are opposed to each other, and wherein the X-ray reflector is configured to allow X-rays entering one of the grooves approximately parallel thereto to undergo total reflection at the reflecting surface of the silicon plate body opposed to the groove, and then exit from a distal end of the groove.

According to a fifth aspect of the present invention, there is provided an X-ray reflecting device which comprises a plurality of the above X-ray reflectors, wherein the X-ray reflectors are arranged around a straight line parallel to an entrance direction of the X-rays while positioning the straight line as an axis of symmetry, in such a manner as to allow X-rays exiting from the X-ray reflectors to be converged.

According to a sixth aspect of the present invention, there is provided a method of producing an X-ray reflecting mirror. The method comprises: a smoothing step of smoothing a surface of a silicon plate to a degree available for X-ray reflection; and a plastically deforming step of applying pressure and heat to the silicon plate by a master die having a given curved surface shape, to cause plastic deformation therein and thereby form the surface of the silicon plate into a given curved surface shape. More specifically, the silicon plate is subjected to a high-temperature pressing process in a temperature range allowing the silicon plate to be plastically deformed to any shape, to form a reflecting surface having a given curved surface shape.

In the above method, the curved surface shape may include a part of a paraboloid of revolution and a part of a hyperboloid of revolution. This makes it possible to provide an X-ray reflecting mirror configured to allow X-rays to undergo total reflection once at each of the paraboloid-of-revolution surface and the hyperboloid-of-revolution surface, and form the X-ray reflecting mirror by a single process.

According to a seventh aspect of the present invention, there is provided another method of producing an X-ray reflecting mirror The method comprises: a smoothing step of smoothing an obverse surface of a silicon plate to a degree available for X-ray reflection; a groove forming step of forming a large number of parallel grooves on a reverse surface of the silicon plate by lithography; and a plastically deforming step of applying pressure and heat to the silicon plate by a master die having a given curved surface shape, to cause plastic deformation therein and thereby form the obverse surface of the silicon plate into a given curved surface shape.

In the above method, the plastically deforming step may include simultaneously performing annealing in an hydrogen atmosphere. This makes it possible to increase a degree of smoothness of a reflecting surface to provide enhanced reflecting performance.

The above method may comprise a step of, after the plastically deforming step, forming a single-layer or multilayer metal thin film on the smoothed silicon surface. This makes it possible to reflect higher-energy X-rays, as compared with a reflecting mirror using a silicon surface itself as a reflecting surface.

In the present invention, the X-ray reflecting mirror is made of silicon, and can be fabricated to have a small thickness, so that it becomes possible to reduce an overall weight of an X-ray reflecting device, which is advantageous for transportation to cosmic space. In addition, based on subjecting the silicon plate (silicon wafer) to plastic deformation, a curved surface shape of a reflecting surface can be stabilized, so that it becomes possible to provide an X-ray reflecting minor having high focusing performance (reflecting performance).

DESCRIPTION OF EMBODIMENTS

With reference to the drawings, the present invention will be described based on embodiments thereof. One feature of the embodiments of the present invention is to subject a silicon plate (silicon wafer) to thermal plastic deformation to thereby provide an X-ray reflecting mirror having a reflecting surface with a stable curved surface shape. A silicon wafer can be deformed to any shape by applying a pressure thereto in a hydrogen atmosphere at a high temperature of about 1300° C. (the Non-Patent Document 3). Further, as a secondary effect, by subjecting the silicon plate to hydrogen annealing, roughness of a silicon surface is further reduced to provide enhanced reflectance (the Non-Patent Document 4). Although there has been known a technical concept of using a thermally deformed silicon wafer as a Bragg reflection-based (normal incidence) optics (the Non-Patent Document 3), a technical concept of using it as an X-ray totally reflecting mirror has not been known.

EXAMPLE 1

Figure 1:
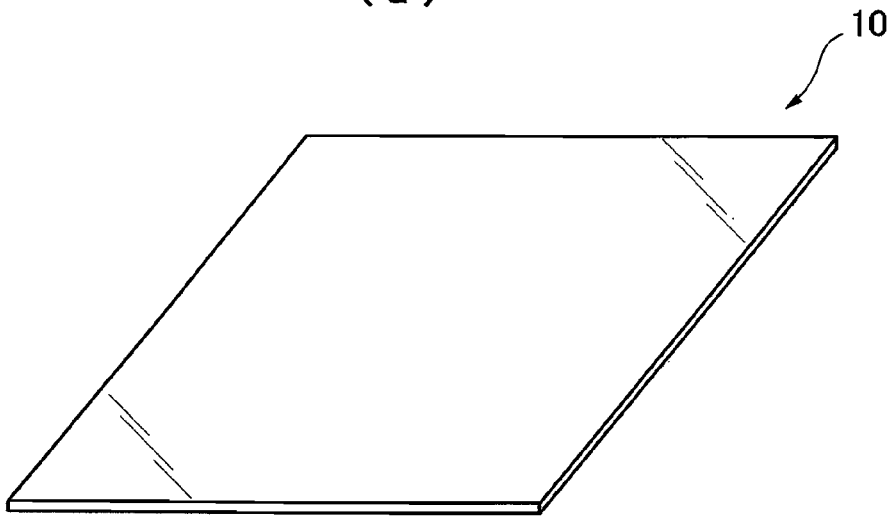
FIGS. 1(*a*) and 1(*b*) are schematic diagrams showing a planar-shaped silicon plate before being subjected to plastic deformation, and a double curved-surface X-ray reflecting mirror obtained by subjecting the silicon plate to plastic deformation.
Figure 1:
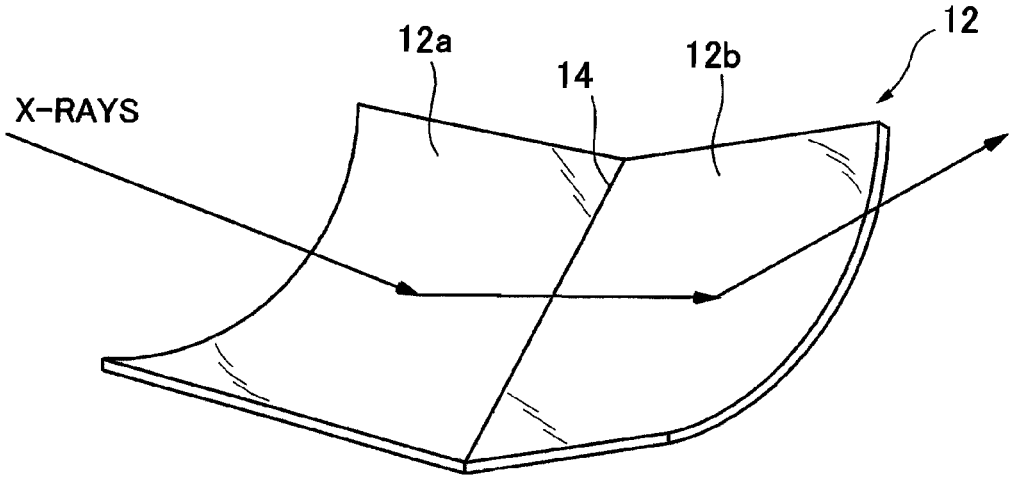

FIG. 1(*a*) illustrates a planar-shaped silicon plate (silicon wafer) 10 before being subjected to plastic deformation, and FIG. 1(*b*) illustrates a silicon reflecting mirror 12 obtained by subjecting the silicon plate 10 to plastic deformation. FIG. 1(*b*) also illustrates a state when an X-ray entering from a left side of the silicon reflecting mirror 12. After the X-ray is reflected by a left surface of the silicon reflecting mirror 12, it is further reflected by a right surface of the silicon reflecting mirror 12. In an example illustrated in FIGS. 1(*a*) and 1(*b*), the silicon reflecting mirror 12 has two different shapes on right and left sides thereof with respect to a central border line 14. Specifically, it is formed as a double curved-surface X-ray reflecting mirror, wherein a left half surface 12*a* is a part of a paraboloid of revolution, and a right half surface 12*b* is a part of a hyperboloid of revolution.

The silicon plate 10 may be subjected to plastic deformation in the following manner. Firstly, the planar-shaped silicon plate illustrated in FIG. 1(*a*) is clamped between master dies (not shown). In this stage, the silicon plate 10 is in an elastically deformed state. In this state, the silicon plate 10 is pressed by applying a pressure to the master dies, while being subjected to hydrogen annealing in a hydrogen atmosphere at a temperature of about 1300° C., until a given time elapses. After elapse of the given time, the silicon plate 10 is gradually cooled. Then, after the silicon plate 10 is fully cooled, it is taken out of the master dies. Through the above process, the silicon plate 10 is plastically deformed. Thus, the silicon reflecting mirror 12 illustrated in FIG. 1(*b*) can be produced by such a relatively simple process. In what shape the silicon reflecting mirror 12 is formed is determined by master dies to be preliminarily prepared. In addition, two sheets of optics for two-stage reflection in a two-stage optics (Wolter type-I) which has heretofore been frequently used in a space X-ray optics can be produced only by single thermal deformation, so that it becomes possible to reduce time/effort and cost of such production accordingly.

The plastic deformation of the silicon plate allows a post-deformed shape thereof to become stable. Thus, differently from elastic deformation, no change in curved surface shape occurs due to aging or temperature change, even if the silicon plate is continuously pressed, so that it becomes possible to maintain a constant level of focusing performance. Furthermore, as described in the Non-Patent Document 4, etc., it is known that a surface of a silicon wafer can be smoothed to an angstrom level by subjecting it to hydrogen annealing. Thus, according to such an improvement in smoothing, reflectance can be further enhanced.

While the obtained silicon reflecting mirror 12 can be practically used as-is, a heavy-metal thin film or multilayer film may be formed on the reflecting surface according to need. This makes it possible to reflect higher-energy X-rays. For example, a metal multilayer film may be formed by sputtering. In this case, a multilayer film-coated reflecting mirror capable of reflecting an X-ray having energy of 10 KeV or more can be obtained.

Figure 2:
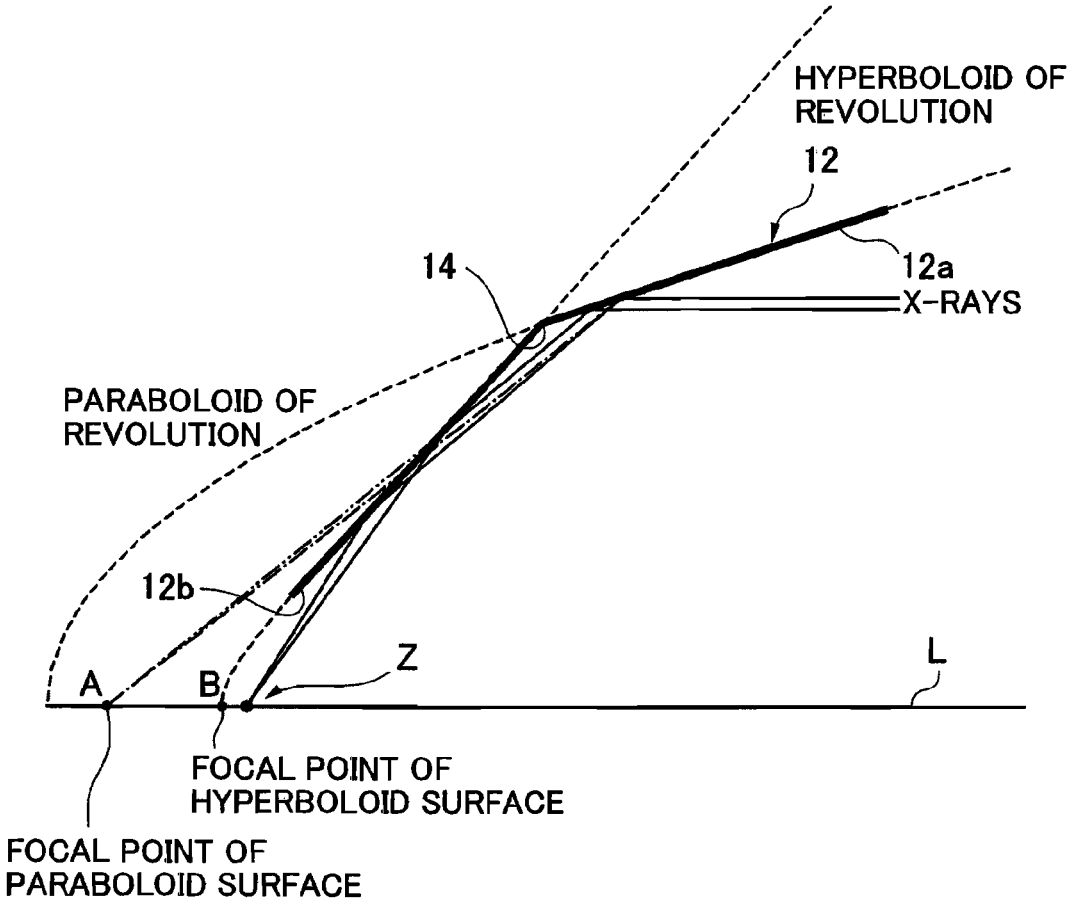
FIG. 2 is a sectional view of the double curved-surface X-ray reflecting mirror illustrated in FIG. 1(*b*).

FIG. 2 is a sectional view of the double curved-surface X-ray reflecting mirror illustrated in FIG. 1(*b*). The dotted lines in FIG. 2 indicate respective extensions of the two curved surfaces constituting the silicon reflecting mirror 12, wherein one of the dotted line is an extension of the paraboloid-of-revolution surface 12*a*, and the other dotted lines is an extension of the hyperboloid-of-revolution surface 12*b*. In FIG. 2, the point A indicates a focal point of the paraboloid-of-revolution surface, and the point B indicates a focal point of the hyperboloid-of-revolution surface. Then, an X-ray reflecting mirror can be formed by arranging a plurality of the silicon reflecting mirrors 12 around a straight line L in FIG. 2 while positioning the straight line L as an central axis (axis of symmetry).

When horizontal X-rays enter from the right side of FIG. 2 to the X-ray reflecting mirror arranged in the above manner, the X-rays are converged on one point Z. Thus this X-ray reflecting mirror can be used as an X-ray telescope. Conversely, when the point Z is set to a point X-ray source, it can be used as an inverted telescope for obtaining parallel X-rays. As compared with a conventional metal-based X-ray telescope, the X-ray telescope and the inverted telescope can be substantially reduced in weight. Thus, they are particularly useful for X-ray observation in cosmic space.

Figure 3:
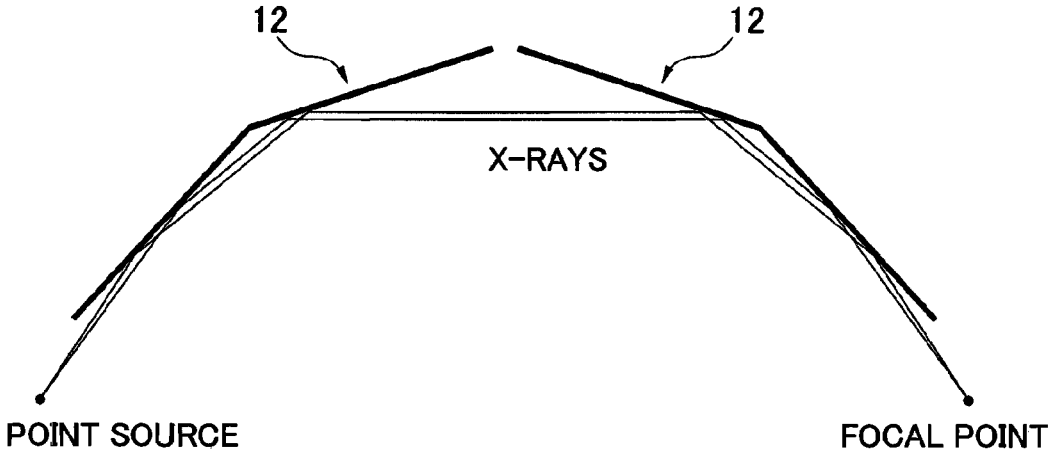
FIG. 3 is a schematic diagram showing a pair of the double curved-surface X-ray reflecting mirrors which are disposed in opposed relation to each other to allow X-rays emitted from a left point source to be converged on a right focal point.

Further, as shown in FIG. 3, a pair of the double curved-surface X-ray reflecting mirrors may be disposed in opposed relation to each other. In this case, X-rays emitted from a left point X-ray source can be converged on a right focal point. This X-ray reflecting mirror can be used for a microanalyzer utilizing X-rays on the earth, etc.

EXAMPLE 2

Figure 4:
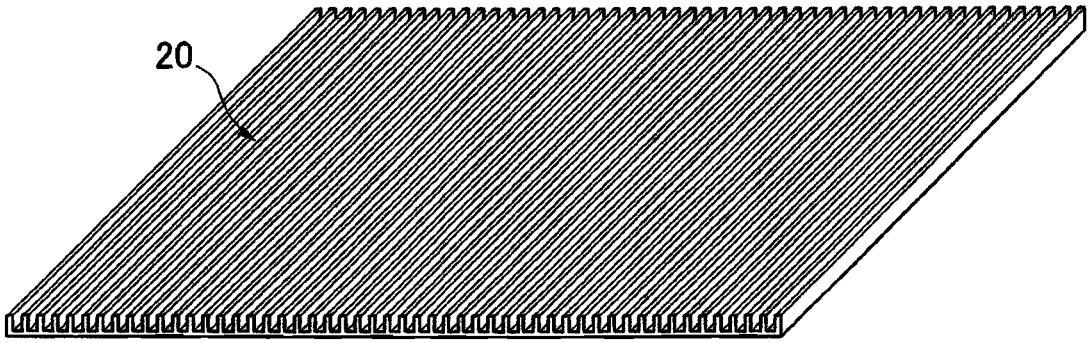
FIGS. 4(*a*) and 4(*b*) are schematic diagrams showing a silicon plate formed with a large number of grooves on a reverse surface thereof (on an upper side of FIG. 4(*a*)).
Figure 4:
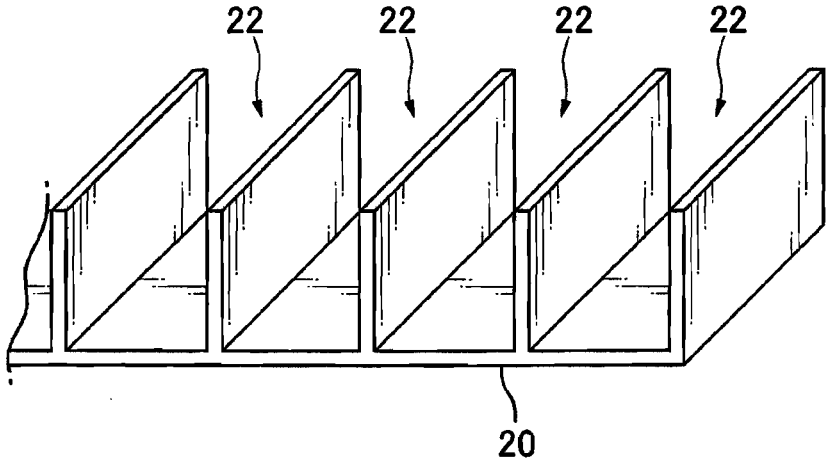
Figure 5:
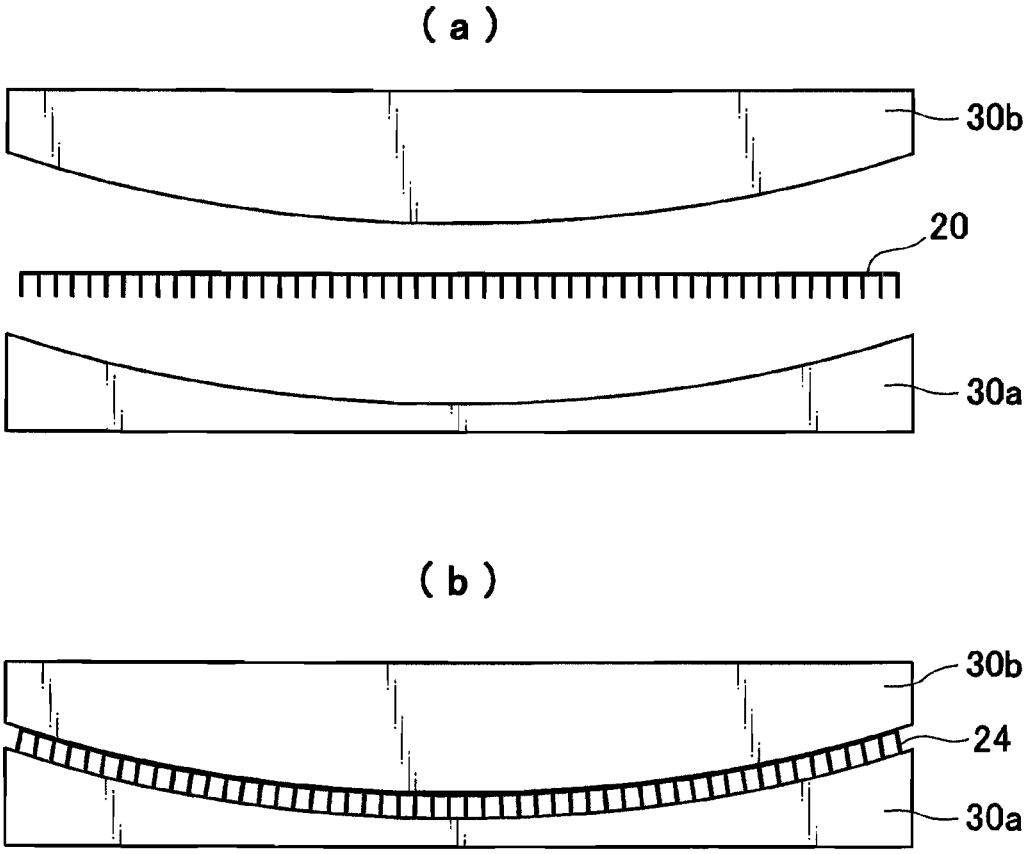
FIGS. 5(*a*) and 5(*b*) are schematic diagrams showing the silicon plate in FIG. 4(*a*), and master dies for plastically deforming the silicon plate.
Figure 6:
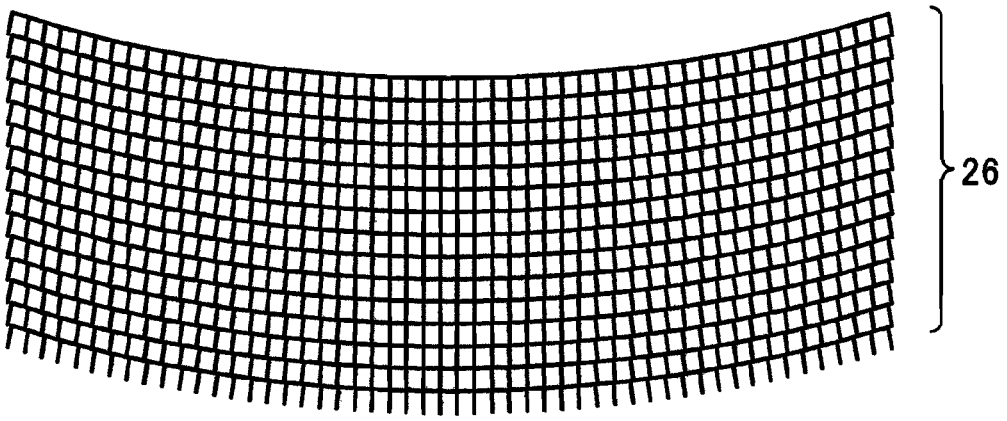
FIG. 6 is a schematic diagram showing an X-ray reflector obtained by laminating a plurality of an X-ray reflecting mirrors.

FIGS. 4 to 6 are explanatory diagrams of an X-ray refracting mirror according to a second embodiment of the present invention. FIG. 4(*a*) illustrates a silicon plate 20 formed with a large number of grooves 22, as enlargedly shown in FIG. 4(*b*), on a reverse surface thereof (on an upper side of FIG. 4(*a*)). These grooves 22 may be formed by lithography which is commonly used for semiconductor devices. An obverse surface of the silicon plate 20 illustrated in FIG. 4(*a*) (on a lower side of FIG. 4(*a*)) serves as a reflecting surface for reflecting X-rays.

FIG. 5(*a*) illustrates the silicon plate 20 in FIG. 4(*a*), and master dies 30*a*, 30*b* for plastically deforming the silicon plate 20. Each of the master dies 30*a*, 30*b* is preliminarily prepared to have a given surface shape. As shown in FIG. 5(*b*), the silicon plate 20 is clamped between the master dies 30*a*, 30*b* in a posture where the reverse surface formed with the grooves 22 is oriented downwardly, and pressed by applying a pressure thereto, while being subjected to hydrogen annealing in an hydrogen atmosphere at a temperature of about 1300° C., in the same manner as that in the first embodiment. Then, after the elapse of a given time, the silicon plate 20 is gradually cooled. In this way, a single sheet of the X-ray reflecting mirror 24 having a reverse surface formed with a large number of grooves is obtained.

A plurality of the resulting X-ray reflecting mirrors 24 are laminated as shown in FIG. 6 to obtain an X-ray reflector 26. This X-ray reflector 26 is configured to allow X-rays entering approximately parallel to each of the grooves from a front side of the drawing sheet to undergo total reflection at the reflecting surface (obverse surface) of each one of the opposed X-ray reflecting mirrors 24 and then exit toward a back side of the drawing sheet. Further, a plurality of the X-ray reflectors 26 can be arranged side-by-side along a circle to form an X-ray reflecting device for converging incoming parallel X-rays.

In this X-ray reflecting device, a post-deformed shape becomes stable, and almost no change in curved surface shape occurs due to aging or temperature change, which provides an advantageous effect of being able to maintain a constant level of focusing performance.

What is claimed is:

1. A mirror to totally reflect X-rays comprising:

a silicon plate body subjected to plastic deformation, wherein the silicon plate body includes a reflecting surface, the reflecting surface of the silicon plate body having a degree of smoothness at an angstrom level for total X-ray reflection, wherein the reflecting surface of the silicon plate body is plastically deformed to have a given curved surface shape configured to totally reflect X-rays; and a large number of X-ray passage grooves formed on a reverse side of the reflecting surface of the silicon plate body to extend parallel to each other, wherein the large number of X-ray passage grooves are formed before the silicon plate body is subjected to the plastic deformation.

2. The mirror as defined in claim 1, wherein the curved surface shape of the reflecting surface of the silicon plate body includes a part of a paraboloid of revolution and a part of a hyperboloid of revolution.

3. The mirror as defined in claim 1, wherein the large number of X-ray passage grooves are formed by lithography.

4. A reflecting device to totally reflect X-rays comprising a plurality of mirrors, wherein each of the plurality of mirrors is a mirror that is comprised of:

a silicon plate body subjected to plastic deformation, wherein the silicon plate body includes a reflecting surface, the reflecting surface of the silicon plate body having a degree of smoothness at an angstrom level for total X-ray reflection, wherein the reflecting surface of the silicon plate body is plastically deformed to have a given curved surface shape configured to totally reflect X-rays; and a large number of X-ray passage grooves formed on a reverse side of the reflecting surface of the silicon plate body to extend parallel to each other, wherein the large number of X-ray passage grooves are formed before the silicon plate body is subjected to the plastic deformation, wherein the curved surface shape of the reflecting surface of the silicon plate body includes a part of a paraboloid of revolution and a part of a hyperboloid of revolution;

wherein the plurality of mirrors are arranged around a straight line so that the straight line becomes a rotation axis for the plurality of minors, and wherein an angle of each of the plurality of mirrors is set to allow X-rays entering parallel to the rotation axis to be reflected once at each of the paraboloid-of-revolution surface and the hyperboloid-of-revolution surface, and then converged.

5. A reflector to totally reflect X-rays comprising:

a plurality of reflecting mirrors, wherein each of the plurality of reflecting minors is a minor that is comprised of:

a silicon plate body subjected to plastic deformation, wherein the silicon plate body includes a reflecting surface, the reflecting surface of the silicon plate body having a degree of smoothness at an angstrom level for total X-ray reflection, wherein the reflecting surface of the silicon plate body is plastically deformed to have a given curved surface shape configured to totally reflect X-rays; and a large number of X-ray passage grooves formed on a reverse side of the reflecting surface of the silicon plate body to extend parallel to each other, wherein the large number of X-ray passage grooves are formed before the silicon plate body is subjected to the plastic deformation;

wherein the plurality of reflecting mirrors are laminated such that the reflecting surface and the groove-formed reverse side are opposed to each other, and wherein the reflector is configured to allow X-rays entering one of the large number of X-ray passage grooves approximately parallel thereto to undergo total reflection at the reflecting surface of the silicon plate body opposed to the groove, and then exit from a distal end of the groove.

6. A reflecting device to totally reflect X-rays comprising:

a plurality of reflectors, wherein each of the plurality of reflectors is a reflector that comprises:

a plurality of reflecting minors, wherein each of the plurality of reflecting mirrors is a mirror that is comprised of:

a silicon plate body subjected to plastic deformation, wherein the silicon plate body includes a reflecting surface, the reflecting surface of the silicon plate body having a degree of smoothness at an angstrom level for total X-ray reflection, wherein the reflecting surface of the silicon plate body is plastically deformed to have a given curved surface shape configured to totally reflect X-rays; and a large number of X-ray passage grooves formed on a reverse side of the reflecting surface of the silicon plate body to extend parallel to each other, wherein the large number of X-ray passage grooves are formed before the silicon plate body is subjected to the plastic deformation;

wherein the plurality of reflecting minors are laminated such that the reflecting surface and the groove-formed reverse side are opposed to each other, and wherein the reflector is configured to allow X-rays entering one of the large number of X-ray passage grooves approximately parallel thereto to undergo total reflection at the reflecting surface of the silicon plate body opposed to the groove, and then exit from a distal end of the groove, wherein the plurality of reflectors are arranged around a straight line parallel to an entrance direction of X-rays so that the straight line becomes a rotation axis for the plurality of reflectors, in such a manner as to allow the X-rays exiting from the plurality of reflectors to be converged.

7. A method of producing a reflecting mirror to totally reflect X-rays, comprising:

a smoothing operation of smoothing a surface of a silicon plate to a degree of smoothness at an angstrom level for total X-ray reflection;

a groove forming operation of forming a large number of parallel grooves on a reverse surface of the silicon plate; and a plastically deforming operation of applying pressure and heat to the silicon plate by a master die having a given curved surface shape, to cause plastic deformation therein and thereby form the surface of the silicon plate to have the given curved surface shape configured to totally reflect X-rays, wherein the plastically deforming operation is performed after the groove forming operation.

8. The method as defined in claim 7, wherein the curved surface shape of the silicon plate includes a part of a paraboloid of revolution and a part of a hyperboloid of revolution.

9. The method as defined in claim 8, wherein the plastically deforming operation includes simultaneously performing annealing in hydrogen atmosphere.

10. The method as defined in claim 7, wherein the plastically deforming operation includes simultaneously performing annealing in hydrogen atmosphere.

11. The method as defined in claim 7, which comprises an operation of, after the plastically deforming operation, forming a single-layer or multilayer metal thin film on the smoothed silicon surface.

12. The method as defined in claim 7, wherein the groove forming operation includes lithography.

* * * * *